US006658380B1

(12) United States Patent
Lockwood et al.

(10) Patent No.: US 6,658,380 B1
(45) Date of Patent: Dec. 2, 2003

(54) METHOD FOR DETECTING SPEECH ACTIVITY

(75) Inventors: Philip Lockwood, Vaureal (FR); Stéphane Lubiarz, Osny (FR)

(73) Assignee: Matra Nortel Communications, Quimper (FR)

( * ) Notice: Subject to any disclaimer, the term of this patent is extended or adjusted under 35 U.S.C. 154(b) by 0 days.

(21) Appl. No.: 09/509,150

(22) PCT Filed: Sep. 16, 1998

(86) PCT No.: PCT/FR98/01979

§ 371 (c)(1),
(2), (4) Date: Jun. 2, 2000

(87) PCT Pub. No.: WO99/14737

PCT Pub. Date: Mar. 25, 1999

(30) Foreign Application Priority Data

Sep. 18, 1997 (FR) ..... 97 11640

(51) Int. Cl.[7] ..... G10L 11/02; G10L 21/02
(52) U.S. Cl. ..... 704/215; 704/226
(58) Field of Search ..... 704/205, 206, 704/210, 215, 226, 227, 228, 233; 381/94.2, 94.3, 94.7

(56) References Cited

U.S. PATENT DOCUMENTS

| | | | | |
|---|---|---|---|---|
| 3,840,708 A | * | 10/1974 | Clark | 370/241 |
| 4,277,645 A | * | 7/1981 | May, Jr. | 704/233 |
| 4,281,218 A | * | 7/1981 | Chuang et al. | 370/435 |
| 5,212,764 A | | 5/1993 | Ariyoshi | |
| 5,228,088 A | | 7/1993 | Kane et al. | |
| 5,469,087 A | | 11/1995 | Eatwell | |
| 5,555,190 A | | 9/1996 | Derby et al. | |
| 5,657,422 A | * | 8/1997 | Janiszewski et al. | 704/229 |
| 5,659,622 A | | 8/1997 | Ashley | |
| 5,732,390 A | | 3/1998 | Katayanagi et al. | |
| 5,742,927 A | * | 4/1998 | Crozier et al. | 704/226 |
| 5,839,101 A | * | 11/1998 | Vahatalo et al. | 704/226 |
| 5,890,108 A | * | 3/1999 | Yeldener | 704/208 |

FOREIGN PATENT DOCUMENTS

| | | |
|---|---|---|
| DE | 40 12 349 | 10/1990 |
| EP | 0 438 174 | 7/1991 |

OTHER PUBLICATIONS

Cavallaro et al., "A fuzzy logic–based speech detection algorithm for communications in noisy environments," Proceedings of the 1998 IEEE International Conference on Acoustics, Speech, and Signal Processing, May 12–15, 1998, vol. 1, pp. 565 to 568.*

Nishiguchi Masayuki et al., <<Voice Signal Transmitter–Receiver>>, Sony Corp., Mar. 1995, vol. 095, No. 006, Abstract.

R Le Bouquin et al., <<Enhancement of Noisy Speech Signals: Application to Mobile Radio Communications>>, Speech Communication, Jan. 1996, vol. 18, No. 1, pp. 3–19.

S Nandkumar et al., <<Speech Enhancement Based on a New Set of Auditaury Constrained Parameters>>, Proceedings of the International Conference on Acoustics, Speech, Signal Processing, ICASSP 1994, Apr. 1994, vol. 1, pp. 1–4.

P Lockwood et al., <<Experiments with a Nonlinear Spectral Subtractor (NSS), Hidden Markov Models and the Projection, for Robust Speech Recognition in Cars>>, Speech Communication, Jun. 1992, vol. 11, No. 2/3, pp. 215–228.

* cited by examiner

*Primary Examiner*—Richemond Dorvil
*Assistant Examiner*—Martin Lerner
(74) *Attorney, Agent, or Firm*—Trop, Pruner & Hu, P.C.

(57) ABSTRACT

A digital speech signal processed by successive frames is subjected to noise suppression taking account of estimates of the noise included in the signal, updated for each frame in a manner dependent on at least one degree of vocal activity. A priori noise suppression is applied to the speech signal of each frame on the basis of estimates of the noise obtained on processing at least one preceding frame, and the energy variations of the a priori noise-suppressed signal are analyzed to detect the degree of vocal activity of said frame.

12 Claims, 5 Drawing Sheets

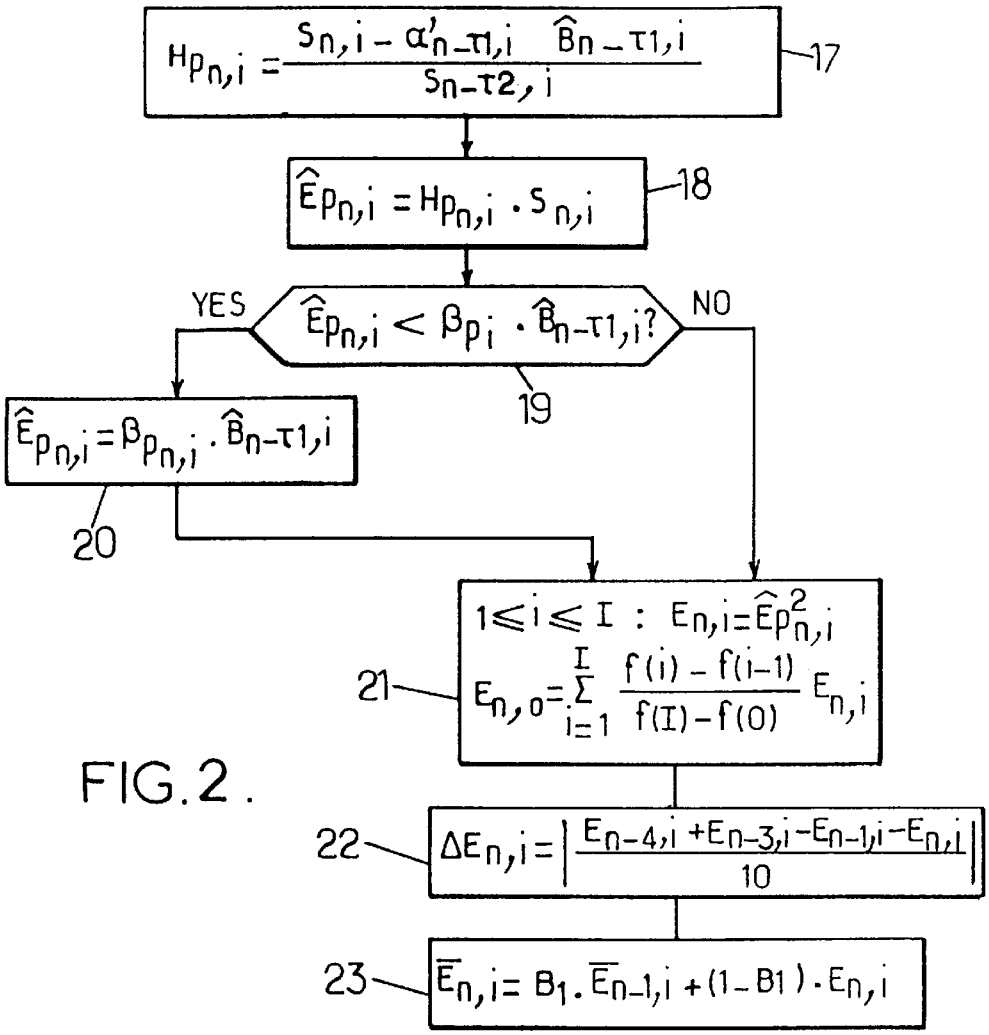
FIG. 2.
FIG. 4.
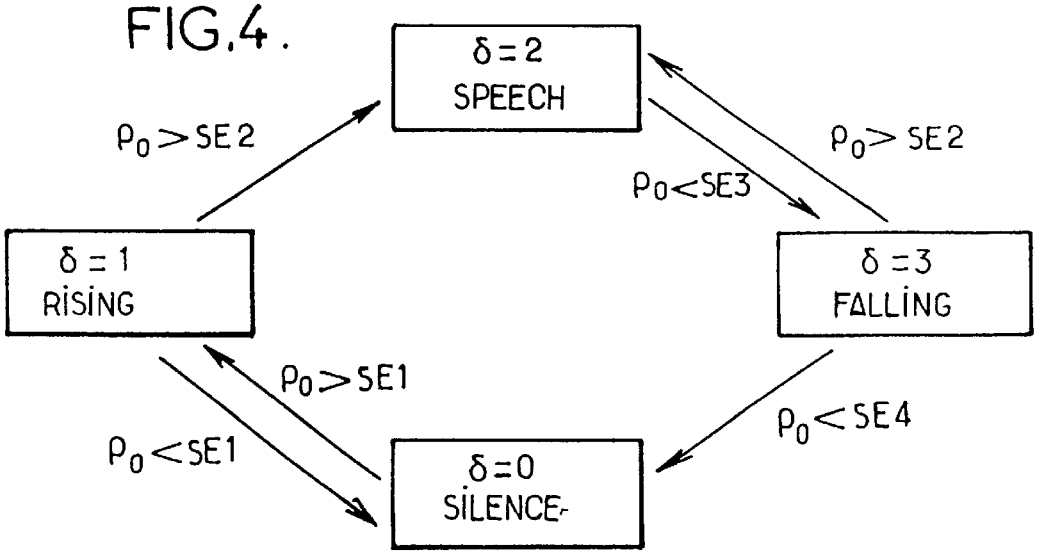

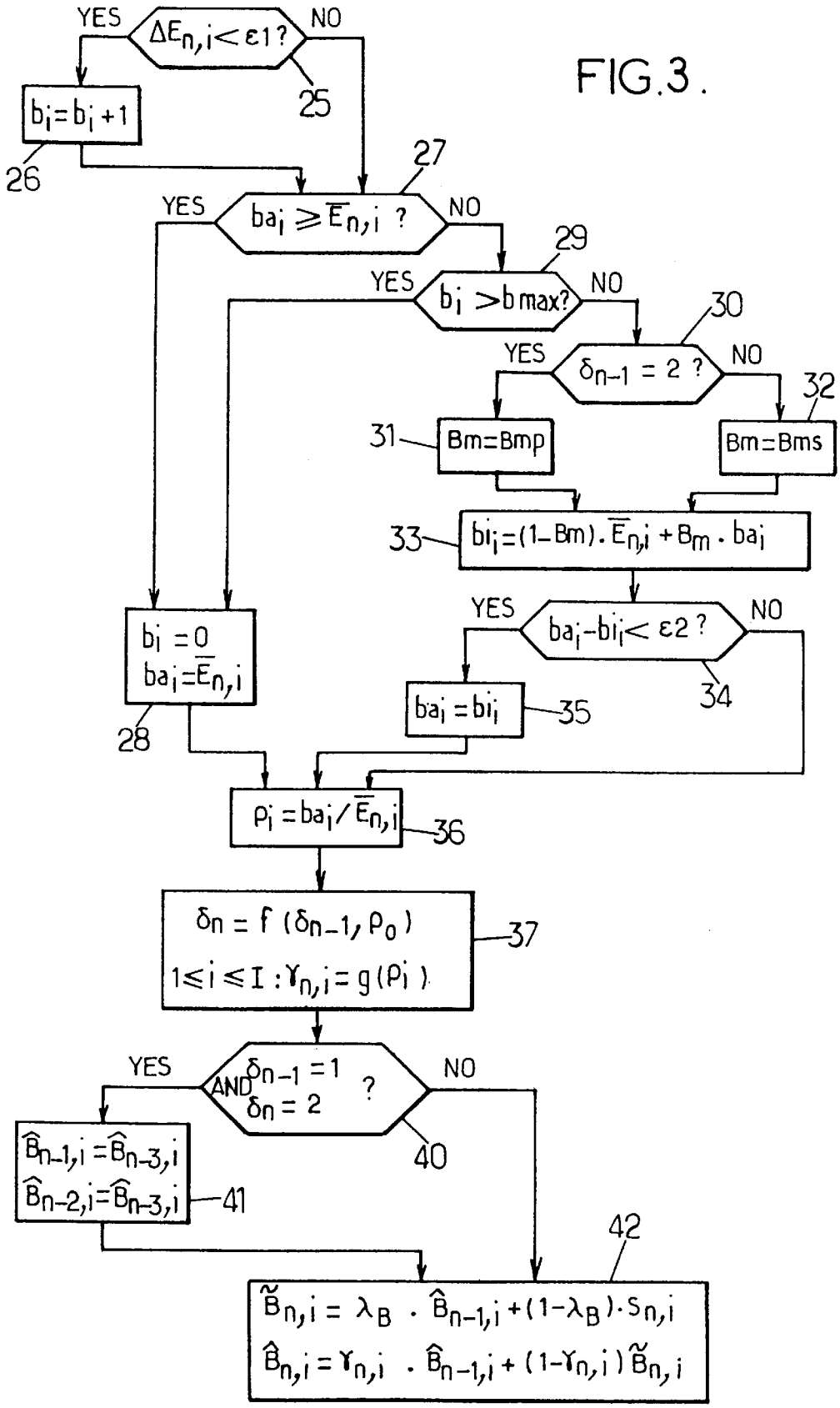
FIG.3.
YES
NO
$\Delta E_{n,i} < \varepsilon 1$ ?
25
$b_i = b_i + 1$
26
27
$ba_i \geq \overline{E}_{n,i}$ ?
29
$b_i > b\,max$?
30
$\delta_{n-1} = 2$ ?
31
$Bm = Bmp$
32
$Bm = Bms$
33
$bi_i = (1 - Bm) \cdot \overline{E}_{n,i} + B_m \cdot ba_i$
$ba_i - bi_i < \varepsilon 2$ ?
34
$ba_i = bi_i$
35
$b_i = 0$
$ba_i = \overline{E}_{n,i}$
28
$\rho_i = ba_i / \overline{E}_{n,i}$
36
$\delta_n = f(\delta_{n-1}, \rho_0)$
$1 \leq i \leq I : \gamma_{n,i} = g(\rho_i)$
37
AND
$\delta_{n-1} = 1$
$\delta_n = 2$
?
40
$\hat{B}_{n-1,i} = \hat{B}_{n-3,i}$
$\hat{B}_{n-2,i} = \hat{B}_{n-3,i}$
41
42
$\tilde{B}_{n,i} = \lambda_B \cdot \hat{B}_{n-1,i} + (1 - \lambda_B) \cdot S_{n,i}$
$\hat{B}_{n,i} = \gamma_{n,i} \cdot \hat{B}_{n-1,i} + (1 - \gamma_{n,i}) \tilde{B}_{n,i}$

METHOD FOR DETECTING SPEECH ACTIVITY

BACKGROUND OF THE INVENTION

The present invention relates to digital speech signal processing techniques. It relates more particularly to techniques which detect vocal activity to perform different processing according to whether the signal is supporting vocal activity or not.

The digital techniques in question relate to various domains: coding of speech for transmission or storage, speech recognition, noise reduction, echo cancellation, etc.

The main difficulty with vocal activity detection methods is distinguishing vocal activity from the accompanying noise. A conventional noise suppression technique cannot solve this problem because these techniques themselves use estimates of the noise which depend on the degree of vocal activity of the signal.

A main object of the present invention is to make vocal activity detection methods more robust to noise.

SUMMARY OF THE INVENTION

The invention therefore proposes a method of detecting vocal activity in a digital speech signal processed by successive frames, in which method the speech signal is subjected to noise suppression taking account of estimates of the noise included in the signal, updated for each frame in a manner dependent on at least one degree of vocal activity determined for said frame. According to the invention, a priori noise suppression is applied to the speech signal of each frame on the basis of estimates of the noise obtained on processing at least one preceding frame, and the energy variations of the a priori noise-suppressed signal are analyzed to detect the degree of vocal activity of said frame.

Detecting vocal activity (as a general rule by any method known in the art) on the basis of a noise-suppressed signal a priori significantly improves the performance of detection if the level of surrounding noise is relatively high.

In the remainder of the present description, the vocal activity detection method of the invention is illustrated within a system for eliminating noise from a speech signal. Clearly the method can find applications in many other types of digital speech processing requiring information on the degree of vocal activity of the processed signal: coding, recognition, echo cancellation, etc.

BRIEF DESCRIPTION OF THE DRAWINGS

FIGS. 2 and 3 are flowcharts of procedures used by a vocal activity detector of the system shown in FIG. 1;

FIG. 4 is a diagram representing the states of a vocal activity detection automaton;

DESCRIPTION OF PREFERRED EMBODIMENTS

Figure 1:
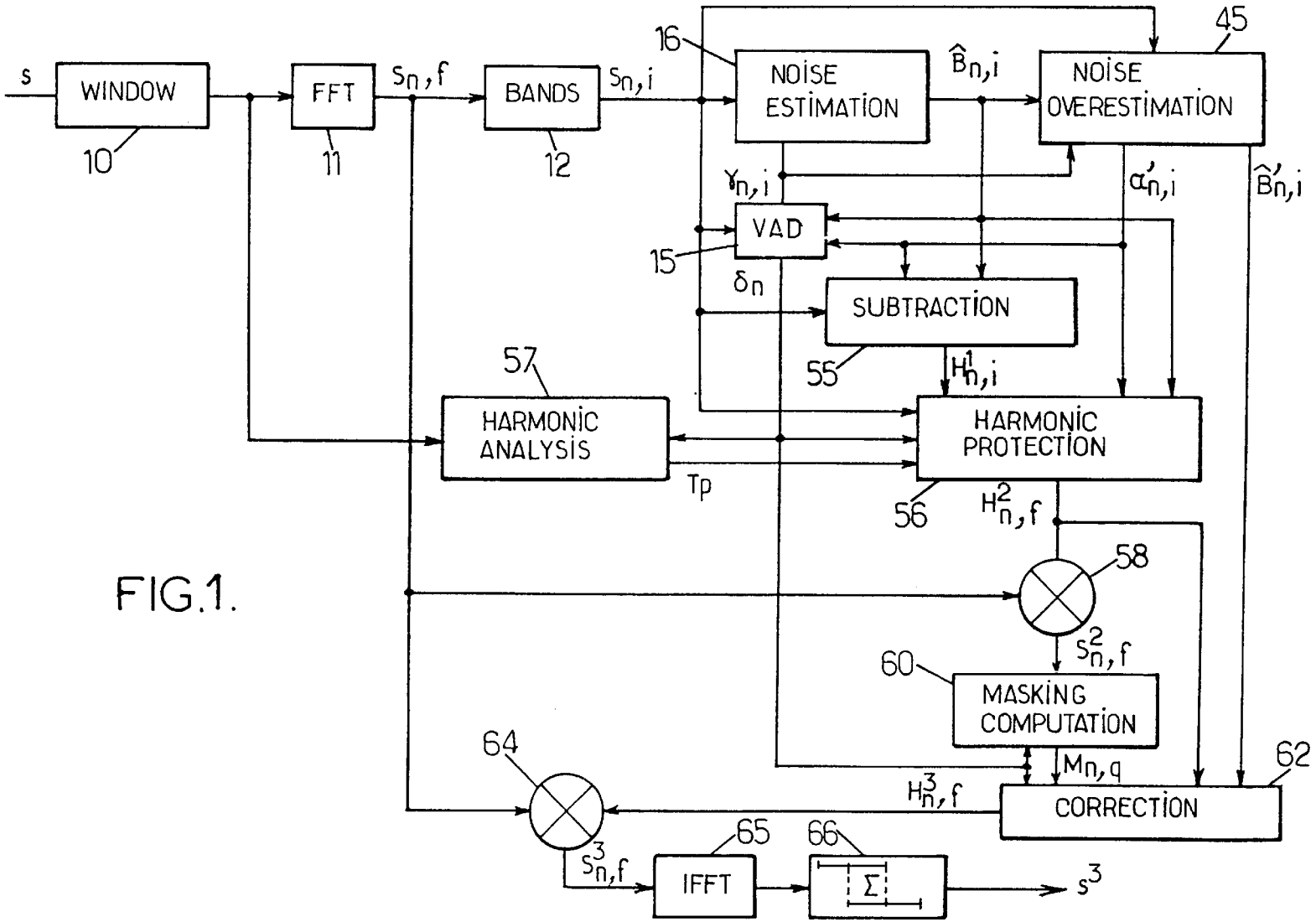
FIG. 1 is a block diagram of a noise suppression system implementing the present invention.

The noise suppression system shown in FIG. 1 processes a digital speech signal s. A windowing module 10 formats the signal s in the form of successive windows or frames each made up of a number N of digital signal samples. In the usual way, these frames can overlap each other. In the remainder of this description, the frames are considered to be made up of N=256 samples with a sampling frequency $F_e$ of 8 kHz, with Hamming weighting in each window and with 50% overlaps between consecutive windows, although this is not limiting on the invention.

The signal frame is transformed into the frequency domain by a module 11 using a conventional fast Fourier transform (FFT) algorithm to compute the modulus of the spectrum of the signal. The module 11 then delivers a set of N=256 frequency components $S_{n,f}$ of the speech signal, where n is the number of the current frame and f is a frequency from the discrete spectrum. Because of the properties of the digital signals in the frequency domain, only the first N/2=128 samples are used.

Instead of using the frequency resolution available downstream of the fast Fourier transform to compute the estimates of the noise contained in the signal s, a lower resolution is used, determined by a number I of frequency bands covering the bandwidth $[0,F_e/2]$ of the signal. Each band i ($1 \leqq i \leqq I$) extends from a lower frequency f(i−1) to a higher frequency f(i), with f(0)=0 and $f(I)=F_e/2$. The subdivision into frequency bands can be uniform ($f(i)-f(I-1)=F_e/2I$). It can also be non-uniform (for example according to a barks scale) A module 12 computes the respective averages of the spectral components $S_{n,f}$ of the speech signal in bands, for example by means of a uniform weighting such as:

$$S_{n,i} = \frac{1}{f(i) - f(i-1)} \sum_{f \in [f(i-1), f(i)[} S_{n,f} \tag{1}$$

This averaging reduces fluctuations between bands by averaging the contributions of the noise in the bands, which reduces the variance of the noise estimator. Also, this averaging greatly reduces the complexity of the system.

The averaged spectral components $S_{n,i}$ are sent to a vocal activity detector module 15 and a noise estimator module 16. The two modules 15, 16 operate conjointly in the sense that degrees of vocal activity $\gamma_{n,i}$ measured for the various bands by the module 15 are used by the module 16 to estimate the long-term energy of the noise in the various bands, whereas the long-term estimates $\hat{B}_{n,i}$ are used by the module 15 for a priori suppression of noise in the speech signal in the various bands to determine the degrees of vocal activity $\gamma_{n,i}$.

The operation of the modules 15 and 16 can correspond to the flowcharts shown in FIGS. 2 and 3.

In steps 17 through 20, the module 15 effects a priori suppression of noise in the speech signal in the various bands i for the signal frame n. This a priori noise suppression is effected by a conventional non-linear spectral subtraction scheme based on estimates of the noise obtained in one or more preceding frames. In step 17, using the resolution of the bands I, the module 15 computes the frequency response $Hp_{n,i}$ of the a priori noise suppression filter from the equation:

$$Hp_{n,i} = \frac{S_{n,i} - \alpha'_{n-\tau 1,i} \cdot \hat{B}_{n-\tau 1,i}}{S_{n-\tau 2,i}} \tag{2}$$

where τ1 and τ2 are delays expressed as a number of frames ($\tau 1 \geqq 1$, $\tau 2 \geqq 0$), and $\alpha'_{n,i}$ an is a noise overestimation coefficient determined as explained later. The delay τ1 can be fixed (for example $\tau 1=1$) or variable. The greater the degree of confidence in the detection of vocal activity, the lower the value of $\tau 1$.

In steps 18 to 20, the spectral components $\hat{E}p_{n,i}$ are computed from:

$$\hat{E}p_{n,i}=\max\{Hp_{n,i}\cdot S_{n,i},\beta p_i\cdot\hat{B}_{n-\tau 1,i}\} \quad (3)$$

where $\beta p_i$ is a floor coefficient close to 0, used conventionally to prevent the spectrum of the noise-suppressed signal from taking negative values or excessively low values which would give rise to musical noise.

Steps 17 to 20 therefore essentially consist of subtracting from the spectrum of the signal an estimate of the a priori estimated noise spectrum, over-weighted by the coefficient $\alpha'_{n-\tau 1,i}$.

In step 21, the module 15 computes the energy of the a priori noise-suppressed signal in the various bands i for frame n: $E_{n,i}=\hat{E}p_{n,i}^2$. It also computes a global average $E_{n,0}$ of the energy of the a priori noise-suppressed signal by summing the energies for each band $E_{n,i}$, weighted by the widths of the bands. In the following notation, the index i=0 is used to designate the global band of the signal.

In steps 22 and 23, the module 15 computes, for each band i ($0\leqq i\leqq I$), a magnitude $\Delta E_{n,i}$ representing the short-term variation in the energy of the noise-suppressed signal in the band i and a long-term value $\overline{E}_{n,i}$ of the energy of the noise-suppressed signal in the band i. The magnitude $\Delta E_{n,i}$ can be computed from a simplified equation:

$$\Delta E_{n,i}=\left|\frac{E_{n-4,i}+E_{n-3,i}-E_{n-1,i}-E_{n,i}}{10}\right|.$$

As for the long-term energy $\overline{E}_{n,i}$, it can be computed using a forgetting factor B1 such that 0<B1<1, namely $\overline{E}_{n,i}=B1\cdot\overline{E}_{n-1},+(1-B1)\cdot E_{n,i}$.

After computing the energies $E_{n,i}$ of the noise-suppressed signal, its short-term variations $\Delta E_{n,i}$ and its long-term values $\overline{E}_{n,i}$ in the manner indicated in FIG. 2, the module 15 computes, for each band i ($0\leqq i\leqq I$), a value $\rho_i$ representative of the evolution of the energy of the noise-suppressed signal. This computation is effected in steps 25 to 36 in FIG. 3, executed for each band i from i=0 to i=I. The computation uses a long-term noise envelope estimator $ba_i$, an internal estimator $bi_i$ and a noisy frame counter $b_i$.

In step 25, the magnitude $\Delta E_{n,i}$ is compared to a threshold $\epsilon 1$. If the threshold $\epsilon 1$ has not been reached, the counter $b_i$ is incremented by one unit in step 26. In step 27, the long-term estimator $ba_i$ is compared to the smoothed energy value $\overline{E}_{n,i}$. If $ba_i\geqq\overline{E}_{n,i}$, the estimator $ba_i$ is taken as equal to the smoothed value $\overline{E}_{n,i}$ in step 28 and the counter $b_i$ is reset to zero. The magnitude $\rho_i$, which is taken as equal to $ba_i/\overline{E}_{n,i}$ (step 36), is then equal to 1.

If step 27 shows that $ba_i<\overline{E}_{n,i}$, the counter $b_i$ is compared to a limit value bmax in step 29. If $b_i>bmax$, the signal is considered to be too stationary to support vocal activity. The aforementioned step 28, which amounts to considering that the frame contains only noise, is then executed. If $b_i\leqq bmax$ in step 29, the internal estimator $bi_i$ is computed in step 33 from the equation:

$$bi_i=(1-Bm)\cdot\overline{E}_{n,i}+Bm\cdot ba_i \quad (4)$$

In the above equation, Bm represents an update coefficient from 0.90 to 1. Its value differs according to the state of a vocal activity detector automaton (steps 30 to 32). The state $\delta_{n-1}$ is that determined during processing of the preceding frame. If the automaton is in a speech detection state ($\delta_{n-1}=2$ in step 30), the coefficient Bm takes a value Bmp very close to 1 so the noise estimator is very slightly updated in the presence of speech. Otherwise, the coefficient Bm takes a lower value Bms to enable more meaningful updating of the noise estimator in the silence phase. In step 34, the difference $ba_i-bi_i$ between the long-term estimator and the internal noise estimator is compared with a threshold $\epsilon 2$. If the threshold $\epsilon 2$ has not been reached, the long-term estimator $ba_i$ is updated with the value of the internal estimator $bi_i$ in step 35. Otherwise, the long-term estimator $ba_i$ remains unchanged. This prevents sudden variations due to a speech signal causing the noise estimator to be updated.

After the magnitudes $\rho_i$ have been obtained, the module 15 proceeds to the vocal activity decisions of step 37. The module 15 first updates the state of the detection automaton according to the magnitude $\rho_0$ calculated for all of the band of the signal. The new state $\delta_n$ of the automaton depends on the preceding state $\delta_{n-1}$ and on $\rho_0$, as shown in FIG. 4.

Four states are possible: $\delta=0$ detects silence, or absence of speech, $\delta=2$ detects the presence of vocal activity and states $\delta=1$ and $\delta=3$ are intermediate rising and falling states. If the automaton is in the silence state ($\delta_{n-1}=0$) it remains there if $\rho_0$ does not exceed a first threshold SE1, and otherwise goes to the rising state. In the rising state ($\delta_{n-1}=1$), it reverts to the silence state if $\rho_0$ is smaller than the threshold SE1, goes to the speech state if $\rho_0$ is greater than a second threshold SE2 greater than the threshold SE1 and it remains in the rising state if SE1$\leqq\rho_0\leqq$SE2. If the automaton is in the speech state ($\delta_{n-1}=2$), it remains there if $\rho_0$ exceeds a third threshold SE3 lower than the threshold SE2, and enters the falling state otherwise. In the falling state ($\delta_{n-1}=3$), the automaton reverts to the speech state if $\rho_0$ is higher than the threshold SE2, reverts the silence state if $\rho_0$ is below a fourth threshold SE4 lower than the threshold SE2 and remains in the falling state if SE4$\leqq\rho_0\leqq$SE2.

Figure 5:
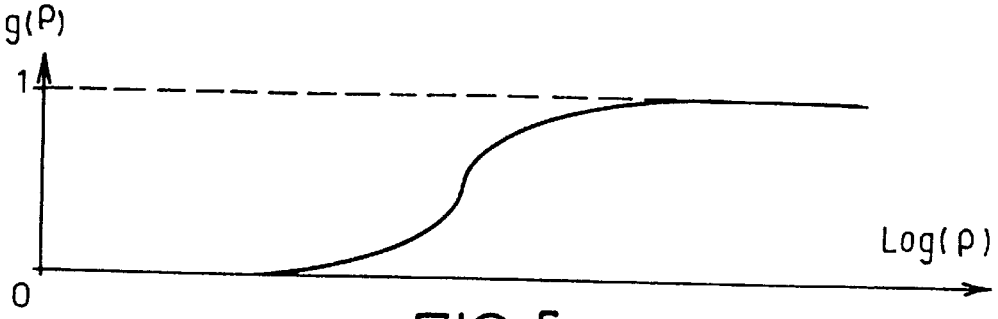
FIG. 5 is a graph showing variations in a degree of vocal activity.

In step 37, the module 15 also computes the degrees of vocal activity $\gamma_{n,i}$ in each band $i\geqq 1$. This degree $\gamma_{n,i}$ is preferably a non-binary parameter, i.e. the function $\gamma_{n,i}=g(\rho_i)$ is a function varying continuously in the range from 0 to 1 as a function of the values taken by the magnitude $\rho_i$. This function has the shape shown in FIG. 5, for example.

The module 16 calculates the estimates of the noise on a band by band basis, and the estimates are used in the noise suppression process, employing successive values of the components $S_{n,i}$ and the degrees of vocal activity $\gamma_{n,i}$. This corresponds to steps 40 to 42 in FIG. 3. Step 40 determines if the vocal activity detector automaton has just gone from the rising state to the speech state. If so, the last two estimates $\hat{B}_{n-1,i}$ and $\hat{B}_{n-2,i}$ previously computed for each band $i\geqq 1$ are corrected according to the value of the preceding estimate $\hat{B}_{n-3,i}$. The correction is done to allow for the fact that, in the rise phase ($\delta=1$), the long-term estimates of the energy of the noise in the vocal activity detection process (steps 30 to 33) were computed as if the signal included only noise (Bm=Bms), with the result that they may be subject to error.

In step 42, the module 16 updates the estimates of the noise on a band by band basis using the equations:

$$\tilde{B}_{n,i}=\gamma_B\cdot\hat{B}_{n-1,i}+(1-\gamma_B)\cdot S_{n,i} \quad (5)$$

$$\hat{B}_{n,i}=\gamma_{n,i}\cdot\hat{B}_{n-1,i}+(1-\gamma_{n,i})\cdot\tilde{B}_{n,i} \quad (6)$$

in which $\lambda_B$ designates a forgetting factor such that $0<\lambda_B<1$. Equation (6) shows that the non-binary degree of vocal activity $\gamma_{n,i}$ is taken into account.

As previously indicated, the long-term estimates of the noise $\hat{B}_{n,i}$ are overestimated by a module 45 (FIG. 1) before noise suppression by non-linear spectral subtraction. The module 45 computes the overestimation coefficient $\alpha'_{n,i}$ previously referred to, along with an overestimate $\hat{B}'_{n,i}$ which essentially corresponds to $\alpha'_{n,i}\cdot\hat{B}_{n,i}$.

Figure 6:
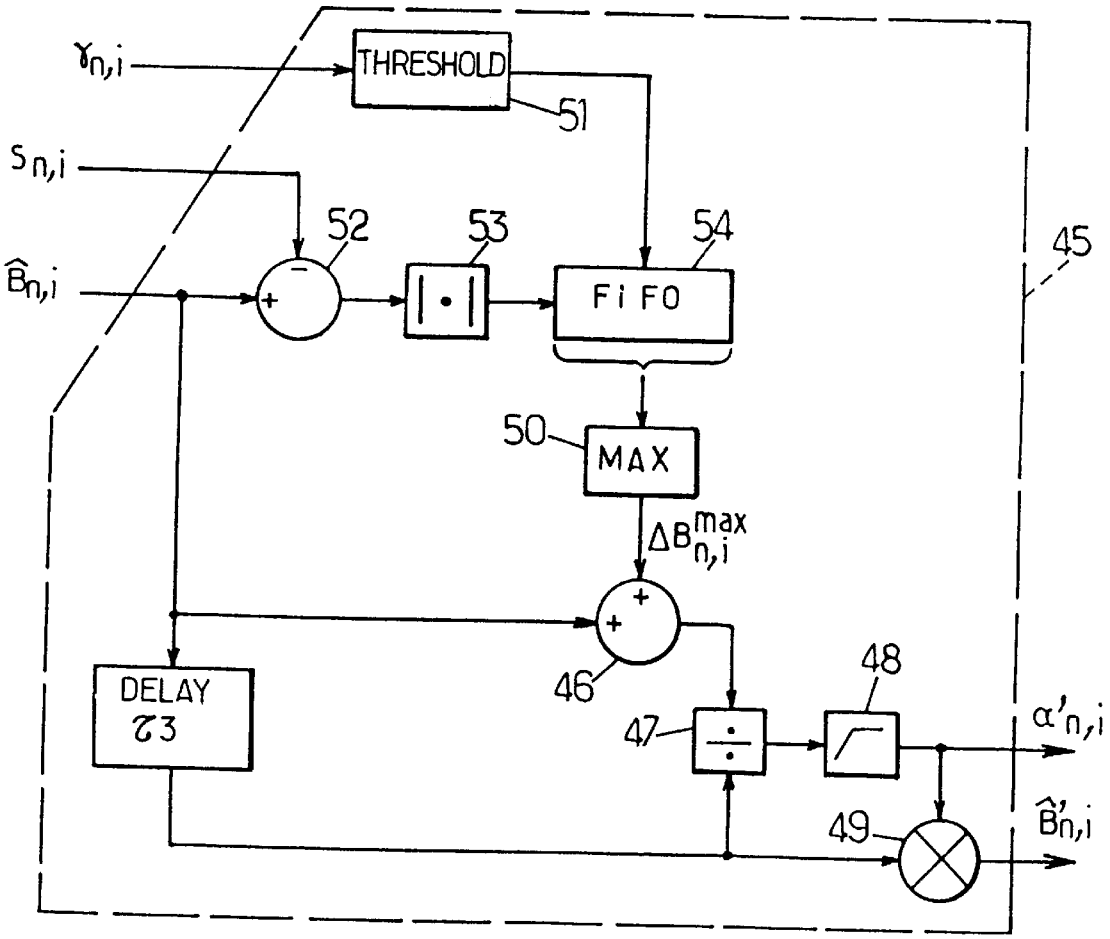
FIG. 6 is a block diagram of a module for overestimating the noise of the system shown in FIG. 1.

FIG. 6 shows the organisation of the overestimation module 45. The overestimate $\hat{B}'_{n,i}$ is obtained by combining the long-term estimate $\hat{B}_{n,i}$ and a measurement $\Delta B_{n,i}^{max}$ of the variability of the component of the noise in the band i around its long-term estimate. In the example considered, the combination is essentially a simple sum performed by an adder 46. It could instead be a weighted sum.

The overestimation coefficient $\alpha'_{n,i}$ is equal to the ratio between the sum $\hat{B}_{n,i}+\Delta B_{n,i}^{max}$ delivered by the adder 46 and the delayed long-term estimate $\hat{B}_{n-\tau 3,i}$ (divider 47), with a ceiling limit value $\alpha_{max}$, for example $\alpha_{max}=4$ (block 48). The delay $\tau 3$ is used to correct the value of the overestimation coefficient $\alpha'_{n,i}$, if necessary, in the rising phases ($\delta=1$), before the long-term estimates have been corrected by steps 40 and 41 from FIG. 3 (for example $\delta 3=3$).

The overestimate $\hat{B}'_{n,i}$ is finally taken as equal to $\alpha'_{n,i}\cdot\hat{B}_{n-\tau 3,i}$ (multiplier 49).

The measurement $\Delta B_{n,i}^{max}$ of the variability of the noise reflects the variance of the noise estimator. It is obtained as a function of the values of $S_{n,i}$ and of $\hat{B}_{n,i}$ computed for a certain number of preceding frames over which the speech signal does not feature any vocal activity in band i. It is a function of the differences $|S_{n-k,i}-\hat{B}_{n-k,i}|$ computed for a number K of silence frames ($n-k\leqq n$). In the example shown, this function is simply the maximum (block 50). For each frame n, the degree of vocal activity $\gamma_{n,i}$ is compared to a threshold (block 51) to decide if the difference $|S_{n,i}-\hat{B}_{n,i}|$, calculated at 52–53, must be loaded into a queue 54 with K locations organised in first-in/first-out (FIFO) mode, or not. If $\gamma_{n,i}$ does not exceed the threshold (which can be equal to 0 if the function g( ) has the form shown in FIG. 5), the FIFO 54 is not loaded; otherwise it is loaded. The maximum value contained in the FIFO 54 is then supplied as the measured variability $\Delta B_{n,i}^{max}$.

The measured variability $\Delta B_{n,i}^{max}$ can instead be obtained as a function of the values $S_{n,f}$ (not $S_{n,i}$) and $\hat{B}_{n,i}$. The procedure is then the same, except that the FIFO 54 contains, instead of $|S_{n-k,i}-\hat{B}_{n-k,i}|$ for each of the bands i, $$\max_{f\in[f(i-1),f(i)[}\left|S_{n-k,f}-\hat{B}_{n-k,i}\right|.$$

Because of the independent estimates of the long-term fluctuations $\hat{B}_{n,i}$ and short-term variability $\Delta B_{n,i}^{max}$ of the noise, the overestimator $\hat{B}'_{n,i}$ makes the noise suppression process highly robust to musical noise.

The module 55 shown in FIG. 1 performs a first spectral subtraction phase. This phase supplies, with the resolution of the bands i ($1\leqq i\leqq I$), the frequency response $H_{n,i}^1$ of a first noise suppression filter, as a function of the components $S_{n,i}$ and $\hat{B}_{n,i}$ and the overestimation coefficients $\alpha'_{n,i}$. This computation can be performed for each band i using the equation:

$$H_{n,i}^1=\frac{\max\{S_{n,i}-\alpha'_{n,i}\cdot\hat{B}_{n,i},\ \beta_i^1\cdot\hat{B}_{n,i}\}}{S_{n-\tau 4,i}} \tag{7}$$

in which $\tau 4$ is an integer delay such that $\tau 4>0$ (for example $\tau 4=0$). The coefficient $\beta_i^1$ in equation (7), like the coefficient $\beta p_i$ in equation (3), represents a floor used conventionally to avoid negative values or excessively low values of the noise-suppressed signal.

In a manner known in the art (see EP-A-0 534 837), the overestimation coefficient $\alpha'_{n,i}$ in equation (7) could be replaced by another coefficient equal to a function of $\alpha'_{n,i}$ and an estimate of the signal-to-noise ratio (for example $S_{n,i}/\hat{B}_{n,i}$) this function being a decreasing function of the estimated value of the signal-to-noise ratio. This function is then equal to $\alpha'_{n,i}$ for the lowest values of the signal-to-noise ratio. If the signal is very noisy, there is clearly no utility in reducing the overestimation factor. This function advantageously decreases toward zero for the highest values of the signal/noise ratio. This protects the highest energy areas of the spectrum, in which the speech signal is the most meaningful, the quantity subtracted from the signal then tending toward zero.

This strategy can be refined by applying it selectively to the harmonics of the pitch frequency of the speech signal if the latter features vocal activity.

Accordingly, in the embodiment shown in FIG. 1, a second noise suppression phase is performed by a harmonic protection module 56. This module computes, with the resolution of the Fourier transform, the frequency response $H_{n,f}^2$ of a second noise suppression filter as a function of the parameters $H_{n,i}^1$, $\alpha'_{n,i}$, $\hat{B}_{n,i}$, $\delta_n$, $S_{n,i}$ and the pitch frequency $f_p=F_e/T_p$ computed outside silence phases by a harmonic analysis module 57. In a silence phase ($\delta_n=0$), the module 56 is not in service, i.e. $H_{n,f}^2=H_{n,i}^1$ for each frequency f of a band i. The module 57 can use any prior art method to analyse the speech signal of the frame to determine the pitch period $T_p$, expressed as an integer or fractional number of samples, for example a linear prediction method.

The protection afforded by the module 56 can consist in effecting, for each frequency f belonging to a band i:

$$\begin{cases} H_{n,f}^2=1 \text{ if } \begin{cases} S_{n,i}-\alpha'_{n,i}\cdot\hat{B}_{n,i}>\beta_i^2\cdot\hat{\beta}_{n,i} \\ \text{and } \exists\eta \text{ integer}/|f-\eta\cdot f_p|\leq\Delta f/2 \end{cases} & (8) \\ H_{n,f}^2=H_{n,f}^1 \quad \text{otherwise} & (9) \end{cases}$$

$\Delta f=F_e/N$ represents the spectral resolution of the Fourier transform. If $H_{n,f}^2=1$, the quantity subtracted from the component $S_{n,f}$ is zero. In this computation, the floor coefficients $\beta_i^2$ (for example $\beta_i^2=\beta_i^1$) express the fact that some harmonics of the pitch frequency $f_p$ can be masked by noise, so that there is no utility in protecting them.

This protection strategy is preferably applied for each of the frequencies closest to the harmonics of $f_p$, i.e. for any integer $\eta$.

If $\delta f_p$ denotes the frequency resolution with which the analysis module 57 produces the estimated pitch frequency $f_p$, i.e. if the real pitch frequency is between $f_p-\delta f_p/2$ and $f_p+\delta f_p/2$, then the difference between the $\eta$-th harmonic of the real pitch frequency and its estimate $\eta\times f_p$ (condition (9)) can go up to $\pm\eta\times\delta f_p/2$. For high values of $\eta$, the difference can be greater than the spectral half-resolution $\Delta f/2$ of the Fourier transform. To take account of this uncertainty, and to guarantee good protection of the harmonics of the real pitch, each of the frequencies in the range $[\eta\times f_p-\eta\times\delta f_p/2,\ \eta\times f_p+\eta\times f_p/2]$ can be protected, i.e. condition (9) above can be replaced with:

$$\exists\eta \text{ integer}/|f-\eta\cdot f_p|\leqq(\eta\cdot\delta f_p+\Delta f)/2 \tag{9'}$$

This approach (condition (9')) is of particular benefit if the values of $\eta$ can be high, especially if the process is used in a broadband system.

For each protected frequency, the corrected frequency response $H_{n,f}^2$ can be equal to 1, as indicated above, which in the context of spectral subtraction corresponds to the subtraction of a zero quantity, i.e. to complete protection of the frequency in question. More generally, this corrected frequency response $H_{n,f}^2$ could be taken as equal to a value from 1 to $H_{n,f}^1$ according to the required degree of protection, which corresponds to subtracting a quantity less than that which would be subtracted if the frequency in question were not protected.

The spectral components $S_{n,f}^2$ of a noise-suppressed signal are computed by a multiplier 58:

$$S_{n,f}^2=H_{n,f}^2\cdot S_{n,f} \tag{10}$$

This signal $S_{n,f}^2$ is supplied to a module 60 which computes a masking curve for each frame n by applying a psychoacoustic model of how the human ear perceives sound.

The masking phenomenon is a well-known principle of the operation of the human ear. If two frequencies are present simultaneously, it is possible for one of them not to be audible. It is then said to be masked.

Figure 7:
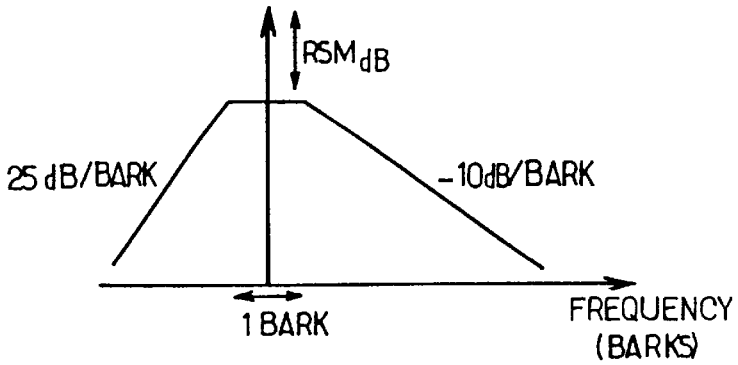
FIG. 7 is a graph illustrating the computation of a masking curve.

There are various methods of computing masking curves. The method developed by J. D. Johnston can be used, for example ("Transform Coding of Audio Signals Using Perceptual Noise Criteria", IEEE Journal on Selected Areas in Communications, Vol. 6, No. 2, February 1988). That method operates in the barks frequency scale. The masking curve is seen as the convolution of the spectrum spreading function of the basilar membrane in the bark domain with the exciter signal, which in the present application is the signal $S_{n,f}^2$. The spectrum spreading function can be modelled in the manner shown in FIG. 7. For each bark band, the contribution of the lower and higher bands convoluted with the spreading function of the basilar membrane is computed from the equation:

$$C_{n,q}=\sum_{q'=0}^{q-1}\frac{S_{n,q'}^2}{(10^{10/10})^{(q-q')}}+\sum_{q'=q+1}^{Q}\frac{S_{n,q'}^2}{(10^{25/10})^{(q'-q)}} \tag{11}$$

in which the indices q and q' designate the bark bands ($0\leqq q,q'\leqq Q$) and $S_{n,q}^2$ represents the average of the components $S_{n,f}^2$ of the noise-suppressed exciter signal for the discrete frequencies f belonging to the bark band q'.

The module 60 obtains the masking threshold $M_{n,q}$ for each bark band q from the equation:

$$M_{n,q}=C_{n,q}/R_q \tag{12}$$

in which $R_q$ depends on whether the signal is relatively more or relatively less voiced. As is well-known in the art, one possible form of $R_q$ is:

$$10\cdot\log_{10}(R_q)=(A+q)\cdot\chi+B\cdot(1-\chi) \tag{13}$$

with A=14.5 and B=5.5. $\chi$ designated a degree of voicing of the speech signal, varying from 0 (no voicing) to 1 (highly voiced signal). The parameter $\chi$ can be of the form known in the art:

$$\chi=\min\left\{\frac{SFM}{SFM_{\max}},1\right\} \tag{12}$$

where SFM represents the ratio in decibels between the arithmetic mean and the geometric mean of the energy of the bark bands and $SFM_{max}$=−60 dB.

The noise suppression system further includes a module 62 which corrects the frequency response of the noise suppression filter as a function of the masking curve $M_{n,q}$ computed by the module 60 and the overestimates $\hat{B}'_{n,i}$ computed by the module 45. The module 62 decides which noise suppression level must really be achieved.

By comparing the envelope of the noise overestimate with the envelope formed by the masking thresholds $M_{n,q}$, a decision is taken to suppress noise in the signal only to the extent that the overestimate +e,cir B'+ee $_{n,i}$ is above the masking curve. This avoids unnecessary suppression of noise masked by speech.

The new response $H_{n,f}^3$, for a frequency f belonging to the band i defined by the module 12 and the bark band q, thus depends on the relative difference between the overestimate $\hat{B}'_{n,i}$ of the corresponding spectral component of the noise and the masking curve $M_{n,q}$, in the following manner:

$$H_{n,f}^3=1-(1-H_{n,f}^2)\cdot\max\left\{\frac{\hat{B}'_{n,i}-M_{n,q}}{\hat{B}'_{n,i}},0\right\} \tag{14}$$

In other words, the quantity subtracted from a spectral component $S_{n,f}$, in the spectral subtraction process having the frequency response $H_{n,f}^3$, is substantially equal to whichever is the lower of the quantity subtracted from this spectral component in the spectral subtraction process having the frequency response $H_{n,f}^2$ and the fraction of the overestimate $\hat{B}'_{n,i}$ of the corresponding spectral component of the noise which possibly exceeds the masking curve $M_{n,q}$.

Figure 8:
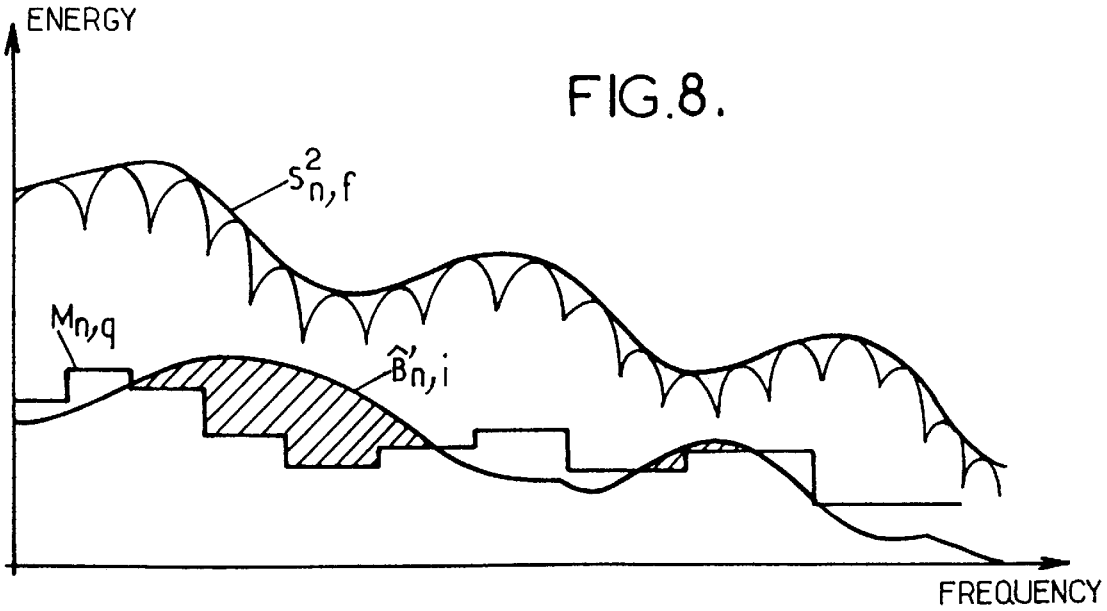
FIG. 8 is a graph illustrating the use of masking curves in the system shown in FIG. 1.

FIG. 8 illustrates the principle of the correction applied by the module 62. It shows in schematic form an example of a masking curve $M_{n,q}$ computed on the basis of the spectral components $S_{n,f}^2$ of the noise-suppressed signal as well as the overestimate $\hat{B}'_{n,i}$ of the noise spectrum. The quantity finally subtracted from the components $S_{n,f}$ is that shown by the shaded areas, i.e. it is limited to the fraction of the overestimate $\hat{B}'_{n,i}$ of the spectral components of the noise which is above the masking curve.

The subtraction is effected by multiplying the frequency response $H_{n,f}^3$ of the noise suppression filter by the spectral components $S_{n,f}$ of the speech signal (multiplier 64). The module 65 then reconstructs the noise-suppressed signal in the time domain by applying the inverse fast Fourier transform (IFFT) to the samples of frequency $S_{n,f}^3$ delivered by the multiplier 64. For each frame, only the first N/2=128 samples of the signal produced by the module 65 are delivered as the final noise-suppressed signal $s^3$, after overlap-add reconstruction with the N/2=128 last samples of the preceding frame (module 66).

What is claimed is:

1. Method of detecting vocal activity in a digital speech signal processed by successive frames, comprising the steps of:

applying a priori noise suppression to the speech signal of each frame on the basis of noise estimates representative of noise included in the signal, said noise estimates being obtained on processing at least one preceding frame;

analyzing energy variations of the a priori noise-suppressed signal to detect at least one degree of vocal activity of said frame; and updating said noise estimates in a manner dependent on said at least one degree of vocal activity detected for said frame.

2. Method according to claim 1, wherein each degree of vocal activity is a non-binary parameter.

3. Method according to claim 2, wherein each degree of vocal activity is a function which varies in a continuous manner in the range from 0 to 1.

4. Method according to claim 1, wherein the noise estimates are obtained in different frequency bands of the signal, the a priori noise suppression is effected band by band, and a degree of vocal activity is determined for each band.

5. Method according to claim 1, wherein a noise estimate $\hat{B}_{n,i}$ is obtained for a frame n in a band of frequencies i in the form:

$$\hat{B}_{n,i}=\gamma_{n,i}\cdot\hat{B}_{n-1,i}+(1-\gamma_{n,i})\cdot\bar{B}_{n,i} \text{ where } \bar{B}_{n,i}=\gamma_B\cdot\hat{B}_{n-1}+(1-\gamma_B)\cdot S_{n,i}$$

where $\lambda_B$ is a forgetting factor in the range from 0 to 1, $\gamma_{n,i}$ is one of said at least one degree of vocal activity determined for the frame n in the band of frequencies i, and $S_{n,i}$ is an average speech signal amplitude in frame n in band i.

6. Method according to claim 5, in which the a priori noise-suppressed signal $\hat{E}p_{n,i}$ relative to a frame n and a band of frequencies i is of the form:

$$\hat{E}p_{n,i}=\max\{Hp_{n,i}\cdot S_{n,i}\beta p_i\cdot\hat{B}_{n-\tau 1,i}\}$$

where $$Hp_{n,i}=\frac{S_{n,i}-\alpha'_{n-\tau 1,i}\cdot\hat{B}_{n-\tau 1},i}{S_{n-\tau 2,i}},$$

$\tau 1$ is an integer at least equal to 1, $\tau 2$ is an integer at least equal to 0, $\alpha'_{n-\tau 1,i}$ is an overestimation coefficient determined for the frame $n-\tau 1$ and the band i, and $\beta p_i$ is a positive coefficient.

7. Method according to claim 1, wherein the step of analysing the energy variations comprises estimating a long-term estimate of the energy of the a priori noise-suppressed signal and comparing said long-term estimate with an instantaneous estimate of said energy, computed over a current frame, to obtain one of said at least one degree of vocal activity of said frame.

8. Voice activity detector for detecting vocal activity in a digital speech signal processed by successive frames, comprising:

means for applying a priori noise suppression to the speech signal of each frame on the basis of noise estimates representative of noise included in the signal, said noise estimates being obtained on processing at least one preceding frame;

means for analyzing energy variations of the a priori noise-suppressed signal to detect at least one degree of vocal activity of said frame; and means for updating said noise estimates in a manner dependent on said at least one degree of vocal activity detected for said frame.

9. Voice activity detector according to claim 8, wherein each degree of vocal activity is a non-binary parameter.

10. Voice activity detector according to claim 9, wherein each degree of vocal activity is a function which varies in a continuous manner in the range from 0 to 1.

11. Voice activity detector according to claim 8, wherein the noise estimates are obtained in different frequency bands of the signal, the means for applying a priori noise suppression to the speech signal operate band by band, and a degree of vocal activity is determined for each band.

12. Voice activity detector according to claim 8, wherein the means for analyzing the energy variations comprises means for estimating a long-term estimate of the energy of the a priori noise-suppressed signal and means for comparing said long-term estimate with an instantaneous estimate of said energy, computed over a current frame, to obtain one of said at least one degree of vocal activity of said frame.

* * * * *

UNITED STATES PATENT AND TRADEMARK OFFICE

CERTIFICATE OF CORRECTION

PATENT NO. : 6,658,380 B1 
DATED : December 2, 2003
INVENTOR(S) : Philip Lockwood and Stephane Lubiarz It is certified that error appears in the above-identified patent and that said Letters Patent is hereby corrected as shown below:

Column 9,
Line 9,

"$\hat{B}_{n,i} = \gamma_{n,i} \cdot \hat{B}_{n-1,i} + (1-\gamma_{n,i}) \cdot \tilde{B}_{n,i}$ where $\tilde{B}_{n,i} = \gamma_B \cdot \hat{B}_{n-1,i} + (1-\gamma_B) \cdot S_{n,i}$"

should be:
-- $\hat{B}_{n,i} = \gamma_{n,i} \cdot \hat{B}_{n-1,i} + (1-\gamma_{n,i}) \cdot \tilde{B}_{n,i}$ where $\tilde{B}_{n,i} = \lambda_B \cdot \hat{B}_{n-1,i} + (1-\lambda_B) \cdot S_{n,i}$ --

Signed and Sealed this

Twenty-fourth Day of February, 2004

JON W. DUDAS
*Acting Director of the United States Patent and Trademark Office*